US006112666A

United States Patent [19]

Murray et al.

[11] Patent Number: 6,112,666

[45] **Date of Patent: *Sep. 5, 2000**

[54] EXPLOSIVES BOOSTER AND PRIMER

[75] Inventors: Christopher Charles Murray, Waverly; Steven Richard Courtley, Surry Hills, both of Australia

[73] Assignee: Orica Explosives Technology Pty. Ltd., Melbourne, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,473

[22] PCT Filed: Oct. 5, 1995

[86] PCT No.: PCT/AU95/00658

§ 371 Date: Jul. 18, 1997

§ 102(e) Date: Jul. 18, 1997

[87] PCT Pub. No.: WO96/11374

PCT Pub. Date: Apr. 18, 1996

[30] Foreign Application Priority Data

Oct. 6, 1994 [AU] Australia ..... PM8617

[51] Int. Cl.[7] ..... C06C 5/06

[52] U.S. Cl. ..... 102/275.12; 102/318

[58] Field of Search ..... 102/318, 322, 102/319, 313, 314, 275.5, 275.6, 275.4, 275.11, 275.12, 301, 333, 320, 275.7

[56] References Cited

U.S. PATENT DOCUMENTS

| | | | |
|---|---|---|---|
| Re. 31,953 | 7/1985 | Calder, Jr. et al. | 102/318 |
| 2,704,031 | 3/1955 | Taylor | 102/319 |
| 3,276,371 | 10/1966 | Newman et al. | 102/319 |
| 3,431,849 | 3/1969 | Kern et al. | 102/318 |
| 3,431,851 | 3/1969 | Kern et al. | 102/318 |
| 3,899,973 | 8/1975 | Brocart | 102/275.5 |
| 3,955,504 | 5/1976 | Romney | 102/318 |
| 4,023,494 | 5/1977 | Barton et al. | 102/314 |
| 4,141,296 | 2/1979 | Calder, Jr. et al. | 102/318 |
| 4,226,184 | 10/1980 | Ljungberg | 102/322 |
| 4,278,025 | 7/1981 | McReynolds | 102/319 |
| 4,485,741 | 12/1984 | Moore et al. | 102/314 |
| 4,776,276 | 10/1988 | Yunan | 102/318 |
| 4,799,428 | 1/1989 | Yunan | 102/322 |
| 5,705,768 | 1/1998 | Ey | 102/275.5 |
| 5,763,816 | 6/1998 | Keeling | 102/322 |
| 5,780,764 | 7/1998 | Welch et al. | 102/318 |

FOREIGN PATENT DOCUMENTS

| | | |
|---|---|---|
| 34196/78 | 3/1978 | Australia . |
| 1586496 | 3/1981 | United Kingdom . |

*Primary Examiner*—Charles T. Jordan
*Assistant Examiner*—Denise J Buckley
*Attorney, Agent, or Firm*—Pillsbury Madison & Sutro LLP

[57] ABSTRACT

The invention relates to an explosives booster (1) which can substantially enclose a detonator (2) and which comprises an integral fastening means (10) for positive retention of non-electric tubing (3) attached to the detonator (2). The primer formed by the combination of said booster and non-electric detonating assembly has improved handling characteristics and can better withstand rough handling.

6 Claims, 5 Drawing Sheets

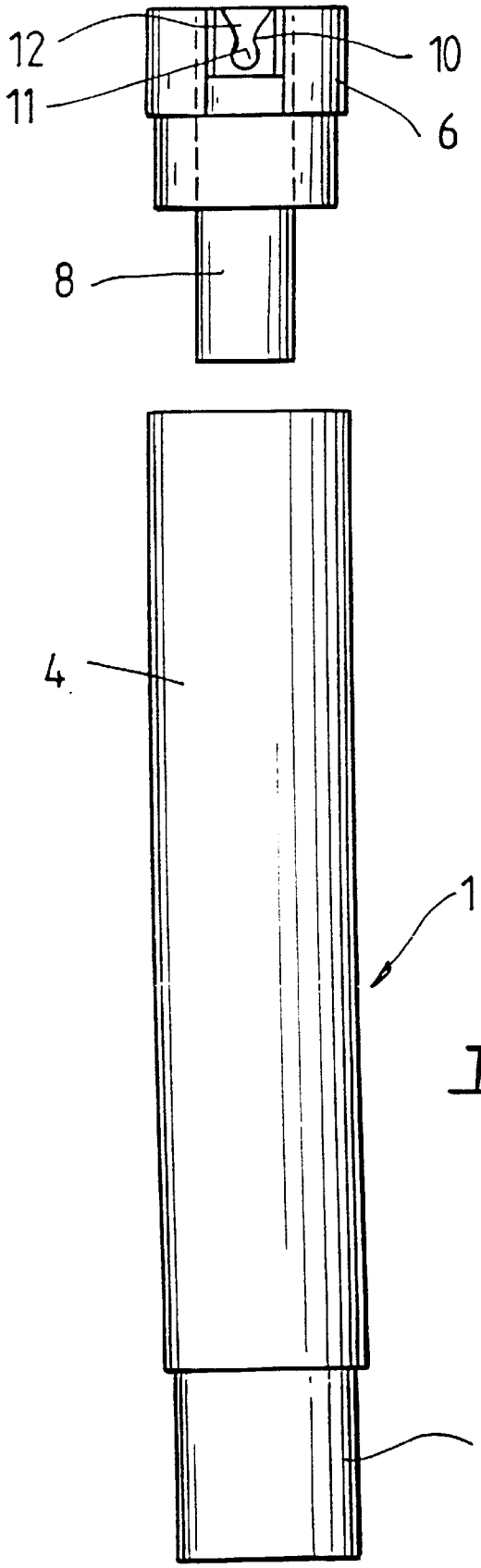
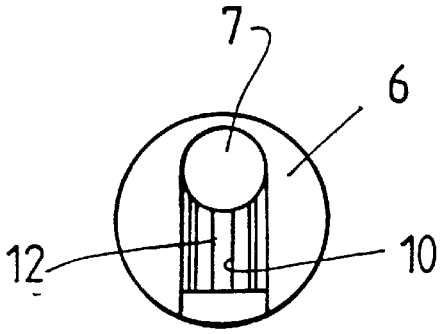
FIG. 2b.
FIG. 2a.

EXPLOSIVES BOOSTER AND PRIMER

FIELD OF THE INVENTION

The present invention relates to an explosives primer and booster.

DESCRIPTION OF THE RELATED ART

Civilian blasting operations require detonation of explosive charges at a controlled time. In mining operations this commonly requires the detonation of a number of blastholes, each filled with a large explosive charge, the blastholes being detonated at a controlled time and in a controlled sequence. This is achieved by devices referred to as "initiating explosives" which transmit signals from one place to another using electrical or chemical (non-electric) energy. Initiation sequences can be controlled by using electrical timing systems or chemical delay elements. Initiating explosives systems incorporate various explosive and inert components which may be wholly or partly consumed in the blast.

Non-electric initiation systems utilise chemical reactions, which can range from rapid burning to violent detonation, to initiate explosive charges either directly or via non-electric detonators. Electric initiation systems require a device which can generate or store electrical energy that is transmitted to electric detonators by a circuit of insulated conductors. A combination of electric and non-electric initiating explosives can be used to initiate blasts but there is a general trend to the use of completely non-electric systems in Australian mines. Non-electric systems cause little disruption to surroundings as they function and provide a high level of safety against accidental initiation by static electricity, stray electrical currents and radio frequency energy.

One of the key components in non-electric initiating systems is non-electric tubing - plastic tubing coated on the inside with a reactive powder. Non-electric tubing or signal tube is commonly attached at one end to a non-electric detonator to form a "detonating assembly". Signal tube has the particular advantage that it cannot be initiated by flame, friction or impact normally encountered in mining operations.

Another commonly used initiating explosive device utilised in blasting is the non-electric primer. A non-electric primer is formed when the non-electric detonator of a detonator assembly is located within a booster—a body of high explosive of tremendous brisance.

In mining applications, the primer is placed in a blasthole which is then filled with packaged or bulk explosives. An initiation signal is triggered from a remote location and passes along the non-electric tubing to the detonator. A small charge of high explosive in the detonator is initiated and explodes, detonating the booster, which in turn causes the larger body of explosive in the blasthole to explode.

Examples of primer systems currently in use include those which use ANZOMEX primers in combination with PRIMADET detonators and EXEL signal tube. (ANZOMEX and EXEL are registered trade marks of ICI Australia Operations Proprietary Limited; PRIMADET is a trade mark of the Ensign Bickford Company). ANZOMEX primers consist of a cylinder of hard explosive, cast to include two passages or wells. The detonator assembly is looped through these passages.

Another related system utilises a slip on booster (SOB) from North American Explosives. (SOB is a U.S. registered trade mark of the Ensign-Bickford Company.) The booster comprises an open cup containing plasticised, soft explosive and a detonator is pressed into the soft matrix. A very similar product is the NOBEL PRIME primer. NOBEL PRIME primers contain a soft, gel-like explosive called PRIMEX, which comprises nitroglycerine/nitroglycol and nitrocellulose in which pentyl and ammonium nitrate are mixed. (NOBEL PRIME and PRIMEX are registered trade marks of Dyno Wesfarmers Ltd.) The soft booster composition partly fills a cylindrical canister up to 100 millameters or more in length and a detonator is pushed through a disk which is formed by an almost complete circle of perforations in the end of the canister. The disk does not break away completely but hinges inward and partly helps to keep the detonator in place. The insertion of the detonator into the booster composition displaces it keep the detonator in place. The insertion of the detonator into the booster composition displaces it sufficiently to fill the canister however if the canister is over filled with booster composition some may squeeze out of the canister and, undesirably, onto the hands of the user.

It is also known to use a cartridge of packaged explosives as a primer. Packaged explosives consist of a paper cylinder or plastic film tube which is filled with soft explosive composition. When used as a primer, a slit is made in the paper or plastic and a detonator inserted.

Several drawbacks are associated with the primers of the prior art and in recent times these have led to serious hazard concerns. In the aforementioned primers of the prior art, the detonator is only held in place by friction and the booster may fall off. While gaffer tape or the like can be utilised with some of the primers of the prior art to try to hold detonators in place, this is not a practical option at large blast sites where hundreds of primers may be required to be made up by hand for a single blast. Attempts to tie or knot signal tube around the booster is not viable as signal tube is too inflexible and resilient to remain knotted or tied.

Concerns have also arisen around the rough handling to which a primer may be subjected during loading into a blasthole. Blastholes are often very narrow—some have a diameter as little as 22 millimeters and primers often get caught up on the rough sides of the blasthole or they may tilt and jam. It has been known for mineworkers to prod a primers with a tool or the end of a bulk explosives loading hose in an effort to knock the primer free and push it further down the blasthole. Alternatively they sometimes try to retrieve the primer from a blasthole by pulling on the non-electric tubing. Such rough handling may cause the detonator to pull out of the primer or the non explosive tubing to pull out of the detonator. While detonators are robust enough to withstand normal handling, the sensitive components inside the detonator can be initiated by intense impact, friction or the non-electric tubing being wrenched out of the detonator shell (called "pull-out"). Even if the detonator does not initiate, if it is disconnected from its non-electric tubing, the blasthole will misfire, that is, fail to detonate at the desired time.

Primers of the prior art often leave the neck and part of the detonator protruding from the booster, leaving the detonator vulnerable to damage. This is a particular problem with NONEL PRIME and SOB boosters where the detonator is merely pushed far enough into the soft explosive composition to cover the base charge in the end of the detonator. Detonators range from about 15 millimeters to 100 millimeters in length depending on the length of the delay element hence a significant proportion of a detonator may protrude from the booster.

Primers are often deliberately positioned or inadvertently moved in a blasthole by emulsion explosive as it is blow loaded. The pressure of air and emulsion passing out of a blow loading hose is often as high as 120 psi and may slam the primer into the walls or toe of the blasthole. Where the blasthole is reversed primed (that is the primer is loaded with the neck of the detonator closest to the toe of the blasthole) a detonator protruding from the booster may receive the full force of an impact against the blasthole walls.

SUMMARY OF THE INVENTION

It has now been found that the safety problems associated with primers of the prior art can be alleviated by the current invention. The current invention provides an explosives primer comprising a booster and non-electric detonator connected to a length of non-electric tubing wherein said booster comprises a casing which substantially encloses said detonator and an integral fastening means for positive retention of said non-electric tubing.

The current invention further provides a booster suitable for use with a detonating assembly which can substantially enclose a detonator said booster comprising an elongate casing having an opening at one end such that a detonator may be inserted substantially parallel or concurrent with the longitudinal axis of the casing, and wherein said casing further comprises an integral fastening means for positive restraint of a non-electric tubing of said detonating assembly.

In use the integral fastening means of the booster positively restrains the non-electric tubing of the detonating assembly such that manual force on the signal tube does not cause the detonator to be pulled out of the primer nor the signal tube to be pulled out of the detonator.

DESCRIPTION OF THE PREFERRED EMBODIMENTS

In a particularly preferred embodiment the signal tube is removably restrained by the fastening means so that if necessary the unexploded detonating assembly can be removed from the booster assembly and re-used elsewhere.

In a preferred embodiment the casing of the booster of the current invention is of cylindrical or other streamlined shape such that if the booster is inserted into a body of bulk explosives it displaces a minimum of the explosive matrix and contact between the booster and the bulk explosive is maximised. The streamlined shape also aids insertion of the booster along blastholes which often have rough walls.

In a preferred embodiment the casing of the booster of the current invention can substantially enclose any of the commercially available civilian detonators currently in use ranging from 15 millimeters to 100 millimeters or more in length. The ability of one booster to fit all lengths of detonators has clear advantages in economy of manufacture.

Blastholes vary in diameter, from as little as 22 millimeters up to about 1 meter in diameter. It is particularly preferred that a single size of booster can be used to successfully initiate explosives in any diameter blasthole.

It may be desirable that the booster of the current invention be adapted for fitting accessories. For example, when a small diameter booster is used in a large diameter blasthole it may be useful to be able to attach a device for maintaining the booster in a central location in the blasthole. If one size or one diameter booster is to used in all diameters of blastholes it could be useful to have different accessories which allow different diameter bulk explosive loading hoses to be used to push the booster into position in a blasthole.

The booster composition may comprise any convenient composition including soft, malleable, plasticised compositions such as PRIMEX or hard, castable compositions such as ANZOMEX. The composition may also be in the form of pressed pellets such as pellets of pentaerithritol tetranitrate wax, pressed pentolite or pressed RDX. Compositions comprising inorganic oxidiser salts and an initially liquid matrix material such as those described in Australian Patent Application 28289/92 may also be suitable for use as the booster composition of the current invention.

If the composition is very soft the detonator may be forced into the composition. Alternatively, if a castable composition is used, a well shaped recess can be formed into which the detonator may be inserted. It is particularly preferred that the explosive composition chosen is fully consumed when the detonator explodes, that is, the burn front passes along the entire length of the booster. If some of the booster composition is not consumed but left in the post-explosion rubble, there is a danger that it may be accidentally detonated at a later time.

In a preferred embodiment the casing may comprise a cylinder and an end cap, plug or the like having an opening for the detonator. The opening for the detonator may comprise a tube or well or other means for urging the detonator into a position essentially parallel to or coaxial with the longitudinal axis of the casing. It will be apparent to those skilled in the art that in smaller diameter boosters it may be necessary to side initiate the booster, that is to locate the detonator close to the casing rather than coaxial with the longitudinal axis of the casing.

The casing of the current invention may comprise any convenient material such as plastic, thin metal, paper or the like. Preferably the material has memory and strength and temperature resistance if it is to be filled with a molten explosive composition. The material may need to be water resistant where the booster is used in wet blastholes.

In one preferred embodiment the integral fastening means for positive retention of signal tube connected to the detonator comprises a substantially L-shaped or U-shaped passage which is closed at one end. In a preferred embodiment the substantially L-shaped or U-shaped passage lies at right angles to the longitudinal axis of the casing. A restraining means is located near the closed end. The restraining means is preferably adapted to allow relatively easy passage of non-electric tube into the closed end of the passage but resist reverse passage or removal of the tubing. In another preferred embodiment the integral fastening means is elongate and comprises elongate well. Signal tube is placed along the length of the fastening means and manual pressure is used to push the tubing past the restraining means into a recess. Alternatively, where short lengths of signal tube are used, the end of the tube may be threaded along the recess.

BRIEF DESCRIPTION OF THE DRAWING

Preferred embodiments of the present invention will now be described by way of the following drawings:

FIGS. 1, 2, 3 and 4 show preferred embodiments of the booster of the current invention

FIG. 1(*a*) is a perspective view of a booster (1). A detonator (2) attached to signal tube (3) is shown alongside the booster to give an idea of the relative sizes. The casing of the booster comprises a cylindrical body (4) having a narrowed foot portion (5) to which loading accessories may be attached and a cap (6). The cap has an opening (7) through which the detonator may be inserted into the casing. A well (8) in the interior of the cylindrical body keeps the detonator parallel to the longitudinal axis of the booster. The signal tube of the detonator may be hooked around the U-shaped passage (9), and forced over the restraining means (10) into the blind pocket (11). FIG. 1(*b*) shows an end-on view of the cap, opening and the passage.

FIG. 2(*a*) shows an elevational view of another embodiment of the booster of the current invention with the cap and cylindrical body separated. In this embodiment the signal tube restraining means comprises a straight passage (12) and the signal tube of a detonator may be laid along this passage and forced over the restraining means (10) into the blind end of the passage (11). FIG. 2(*b*) is an end-on view of the cap (6) showing the opening for insertion of the detonator into the casing (7) and the passage (12).

FIG. 3(*a*) depicts a plan view of a detonator (2) inserted in a booster (1) of the current invention shown in section along an axial plane. In this embodiment the cap (6) has an integral restraining means which comprises gripping arms (13). The gripping arms can be tightened to grip the rubber sleeve (14) located in the neck of the detonator and thus exerts a restraining force on the signal tube (3). The cylindrical body (4) of the booster casing is filled with an explosive composition (15) which has been cast with a recess (15) for insertion of the detonator. The detonator in this drawing does not extend the entire length of the recess; the base charge (16) at the toe of the detonator is well short of the end of the booster. FIG. 3(*b*) is an end-on view of the booster showing the gripping arms (13) around a rubber sleeve (14) and signal tube (3).

FIG. 4(*a*) shows a side view of a detonator (2) and signal tube (3) located in a further embodiment of the booster of the current invention shown in section along an axial plane.

FIG. 5(*a*) is a perspective view of an accessory which may be useful when the booster is to be pushed into position in a blasthole using a bulk explosives loading hose. The accessory comprises a cup (22) which may be attached the booster by interference fit. The cup could, for example, be placed over the tapered foot (5) of the boosters depicted in FIG. 1(*a*) and FIG. 2(*a*). The accessory also comprises an elongate member (23) having several longitudinal fins (24). In use the elongate member can be located in the end of a bulk explosives loading hose, the hose having a diameter greater than the diameter of the elongate member but less than the diameter of the cup. The fins are of a shape which provides minimum displacement of explosive composition and provide a stand off between the hose and the bottom of the cup. If a single size/diameter of booster is to be used in all diameters of blastholes the width and length of the fins could be varied to allow different diameter bulk explosive loading hoses to be used to push the booster into position in a blasthole. FIG. 5(*b*) is an elevational view of the accessory of FIG. 5(*a*) showing the cup of section. FIG. 5(*c*) is an end-on plan view of the accessory of FIG. 5(*b*) showing the arrangement of the four fins. An air relief passage (25) in the base of the cup allows for passage of air as the accessory is pushed along the blasthole.

Figures 1A, 1B:
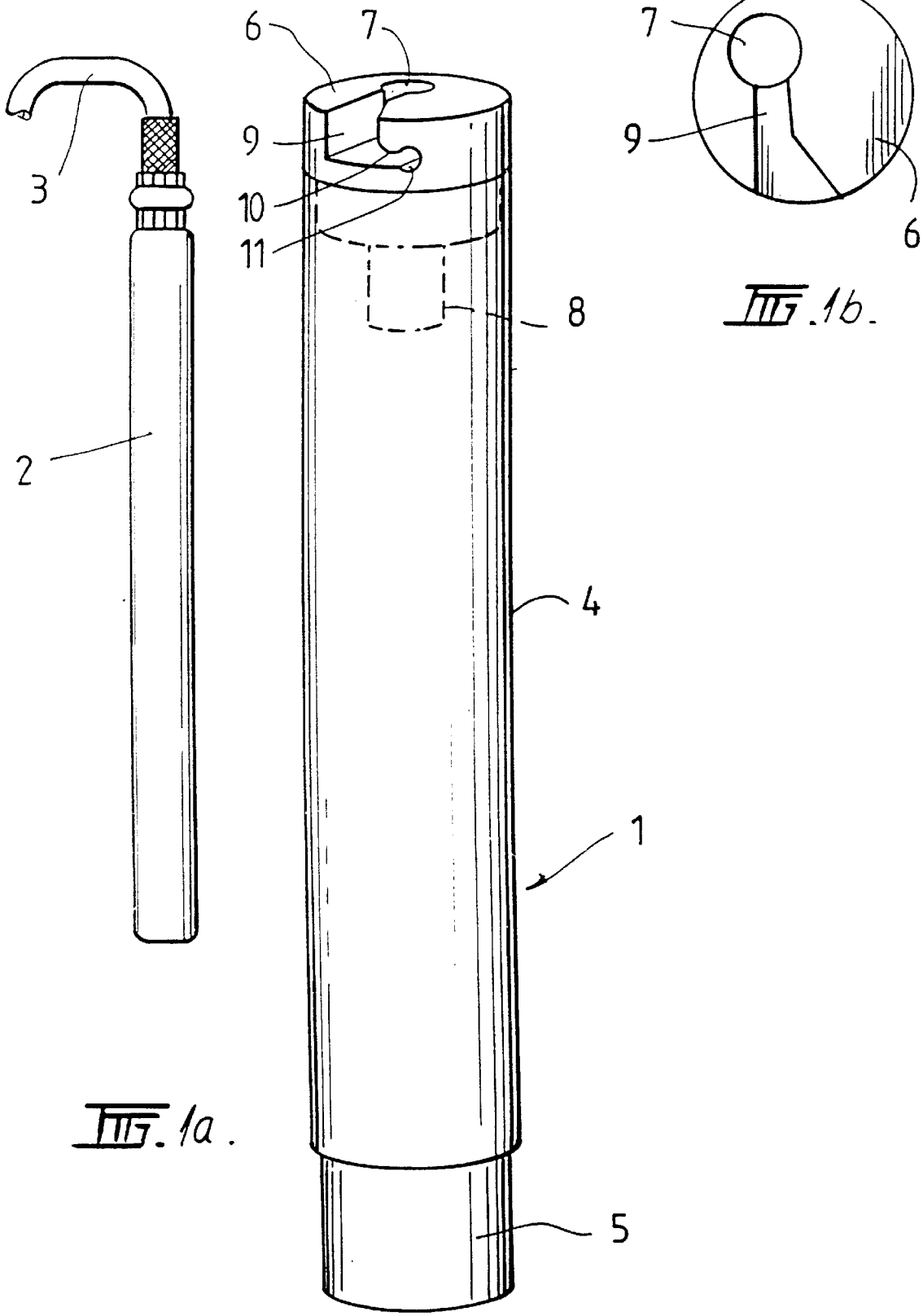
Figure 3A:
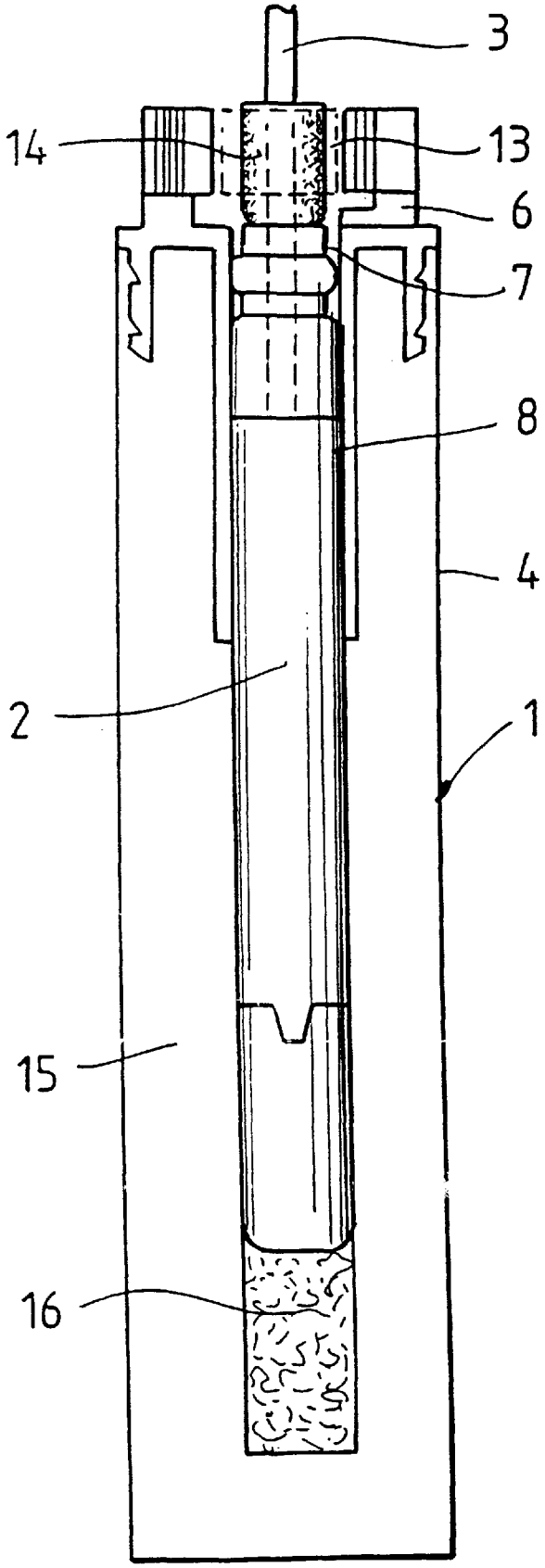
Figure 3B:
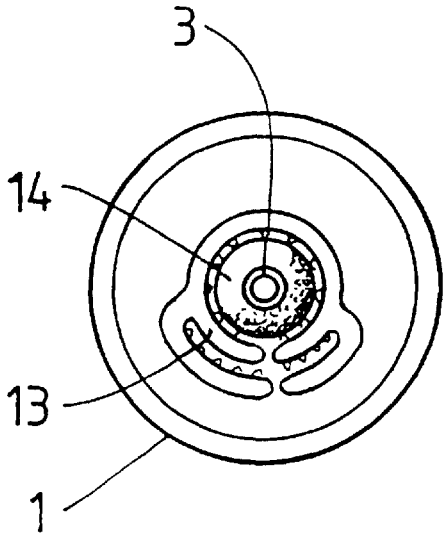
Figure 4A:
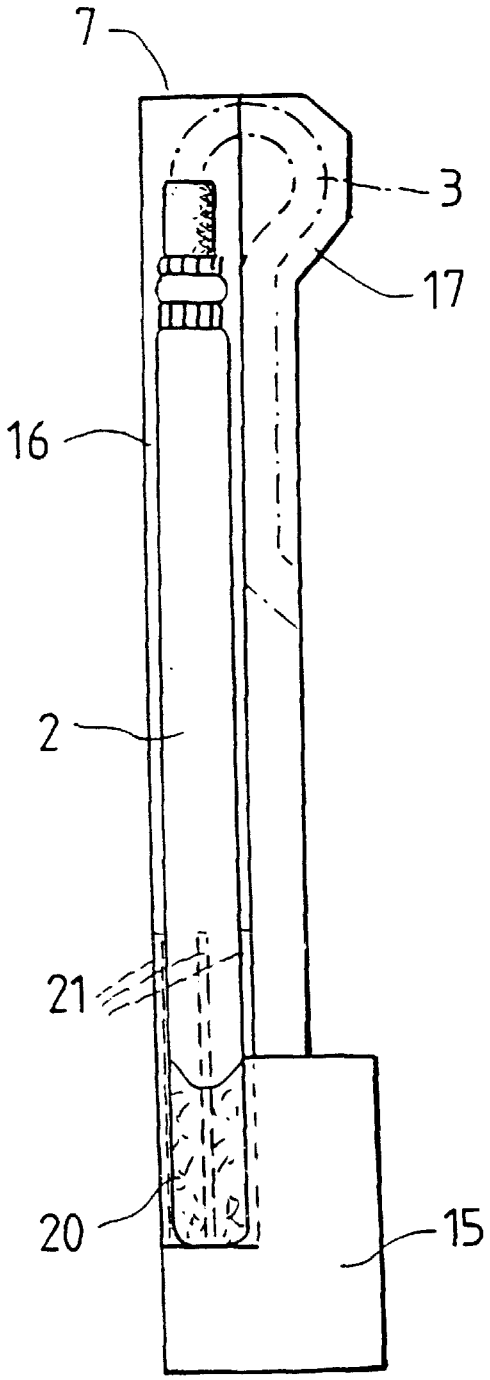
Figure 4B:
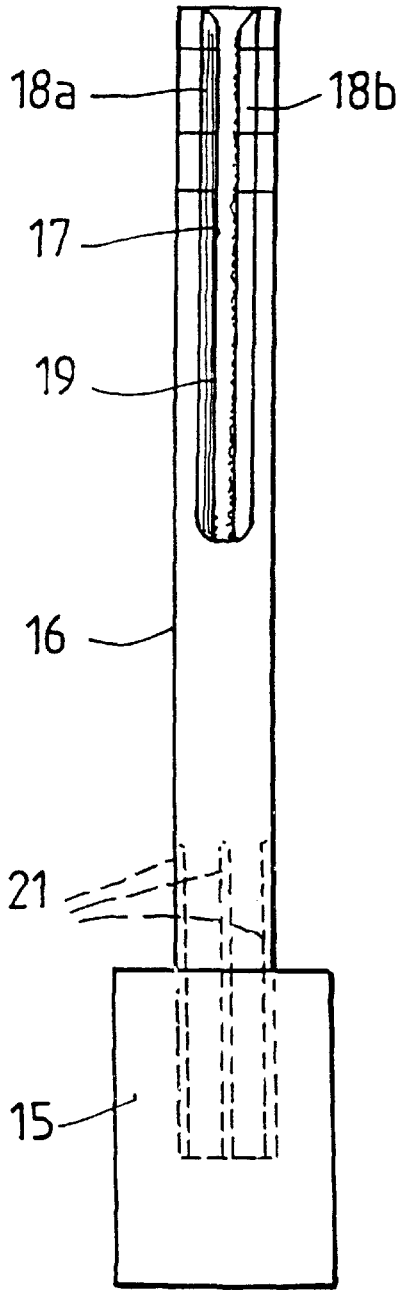
FIG. 4*b* is a front elevational view of the embodiment of FIG. 4*a*. In this embodiment the booster casing comprises a long well (16) into which the detonator is inserted through an opening (7). Fins (21) located on the inside wall of the well help to keep the detonator in position. The signal tube (3) is held by an elongate fastening means (17) which is integral with the casing and runs parallel to the well. In use the signal tube is placed along the length of the fastening means and with thumb pressure is pushed past the restraining means (18*a*,18*b*) into a recess (19). Alternatively, where short lengths of signal tube are used, the end of the tube may be threaded along the recess. The restraining means may comprise resiliently deformable material. In this embodiment the booster explosives composition (15) encloses the base charge (20) of the detonator.
Figure 5C:
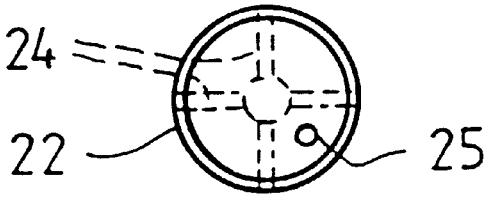
FIG. 5 shows a useful accessory for use with the booster of the current invention.
Figure 5A:
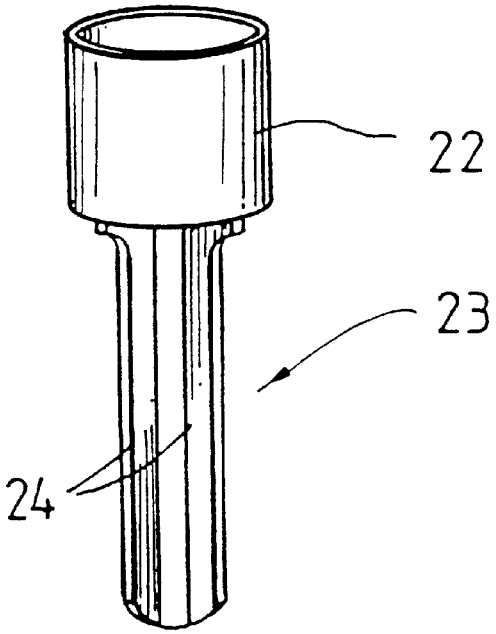
Figure 5B:
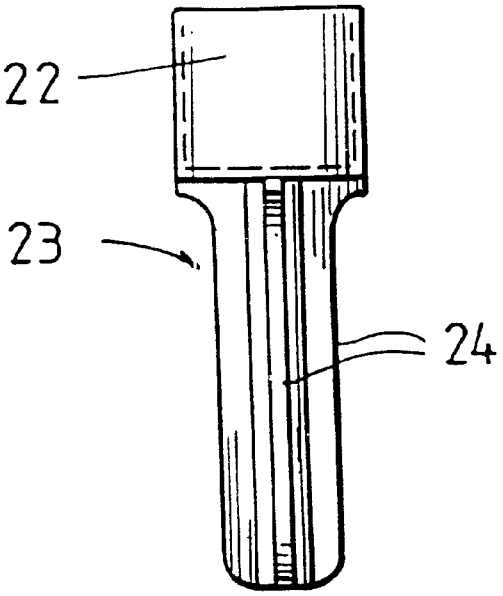

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

The claims defining the invention are as follows:

1. An explosives primer comprising a booster and a non-electric detonator connected to a length of non-electric tubing, said booster comprising an elongate casing having an outer periphery and having an opening at one end such that the detonator is inserted therein substantially parallel with the longitudinal axis of the casing, said casing further comprising an integral fastening means adjacent said opening and in contact with said non-electric tubing for positive retention of the non-electric tubing of said detonator, said non-electric tubing being removably restrained by the fastening means such that if necessary the detonator and tubing, before detonation, can be removed from the booster, wherein said integral fastening means comprises a passage which is open at one side and which extends between said opening and said outer periphery and restraining means which allows entry of the non-electric tubing into said passage through said one side but hinders removal of the tubing from said passage through said one side.

2. A primer according to claim 1 wherein said passage extends at right angles to the longitudinal axis of the casing.

3. A primer according to claim 1 wherein the casing comprises a cylinder and an end cap or plug and wherein the passage and the opening for insertion of said detonator are provided on the end cap or plug.

4. A primer according to claim 3 wherein said opening comprises a tube or well for guiding the detonator into a position essentially parallel to the longitudinal axis of the casing.

5. A primer according to claim 1 wherein said booster is adapted to fit accessories for aiding loading or locating of said primer in a blasthole.

6. A primer according to claim 1 which further comprises an accessory having a cup which is attached to an elongate member and wherein said cup is held on the foot of said booster by interference fit.

* * * * *